US006264049B1

(12) United States Patent
Shteynberg

(10) Patent No.: US 6,264,049 B1
(45) Date of Patent: Jul. 24, 2001

(54) NURSING BOTTLE WITH INTEGRAL TEMPERATURE SENSOR

(76) Inventor: Mark Y. Shteynberg, 6817 208th St. SW., Lynnwood, WA (US) 98036

( * ) Notice: Subject to any disclaimer, the term of this patent is extended or adjusted under 35 U.S.C. 154(b) by 0 days.

(21) Appl. No.: 09/487,276

(22) Filed: Jan. 19, 2000

(51) Int. Cl.[7] ..... A61J 9/02
(52) U.S. Cl. ..... 215/11.2; 215/11.1; 374/150
(58) Field of Search ..... 215/11.2; 374/150

(56) References Cited

U.S. PATENT DOCUMENTS

| | | | | |
|---|---|---|---|---|
| 1,423,038 | * | 7/1922 | Sims | 215/11.2 X |
| 2,648,226 | | 8/1953 | Finch | 73/343 |
| 2,814,202 | | 11/1957 | Frans | 73/343 |
| 3,125,984 | | 3/1964 | Okuyama | 116/114 |
| 3,567,059 | * | 3/1971 | Littman | 215/11.2 |
| 3,682,344 | | 8/1972 | Lopez | 215/11.1 R |
| 4,022,060 | * | 5/1977 | Rebhan | 215/11.2 X |
| 4,156,365 | | 5/1979 | Heinmets | 73/343 B |
| 4,878,588 | | 11/1989 | Ephraim | 215/11.1 |
| 4,919,983 | * | 4/1990 | Fremin | 215/11.2 X |
| 5,211,299 | * | 5/1993 | Manfredonia | 215/11.2 X |
| 5,553,941 | | 9/1996 | Cope | 374/150 |

FOREIGN PATENT DOCUMENTS

| | | | | |
|---|---|---|---|---|
| 678695 | * | 10/1991 | (CH) | 215/11.2 |
| 3917124 | * | 3/1990 | (DE) | 215/11.2 |
| 325607 | * | 5/1903 | (FR) | 215/11.2 |
| 909043 | * | 4/1946 | (FR) | 215/11.2 |
| 1581009 | * | 9/1969 | (FR) | 215/11.2 |
| 2006673 | * | 1/1970 | (FR) | 215/11.2 |
| 2682294 | * | 4/1993 | (FR) | 215/11.2 |
| 2201099 | * | 8/1968 | (GB) | 215/11.2 |

* cited by examiner

*Primary Examiner*—Sue A. Weaver

(57) ABSTRACT

A nursing bottle for handling liquid foods and for feeding infants having a main side wall formed as a hollow shell with an attached elongated hollow appendix compartment propagated into the inner chamber of the bottle. The hollow appendix compartment contains a device for temperature sensing which allows to determine the temperature of liquid foods inside the bottle.

11 Claims, 5 Drawing Sheets

NURSING BOTTLE WITH INTEGRAL TEMPERATURE SENSOR

BACKGROUND OF THE INVENTION

The present invention relates to improvements in feeding bottles and food containers for liquids and loose foods in which the temperature of the content within the bottle is determined. More particularly, it relates to improvements in nursing bottles in a manner that allows to determine the temperature inside of the bottle.

Based upon the fact that the preferable temperature of the food given to an infant (including formulas as well as previously stored mother's milk or even water) has to be of normal human body temperature (36.6° C.±0.5° C.) it is very important to accurately control the temperature of the substance given to the baby. Substance at a temperature that is substantially higher than that mentioned above may burn the baby's lips and mouth, and it is known that food at a temperature significantly below the optimal level might cause indigestion or be rejected by the baby.

The most common conventional method for determining the temperature of the nursing bottle content is the tactile feeling with the hand, palm, or fingers. Though this simple method is generally reliable, in some instances it leaves enough room for error due to its reliance upon the subjective thermal feeling of a particular person. Furthermore, it is influenced by the temperature of the surrounding media as well as the temperature of the media that was surrounding the person's hands before testing the temperature. For example, if some one was washing their hands in hot water before checking the temperature of the nursing bottle content, they will be more likely to overheat the bottle.

There were a number of prior arts aimed to improve the conventional method for determining the temperature of the nursing bottle content.

U.S. Pat. No. 5,553,941 to G. Cope shows a temperature responsive probe with a thermometer unit utilized for temperature indication.

Unfortunately, this proposed method of measuring temperature of the nursing bottle content is cumbersome and inconvenient. The U.S. Pat. No. 5,553,941 shows a thermometer unit installed into the neck of the bottle. This anticipates a two staged process of first determining the temperature and then feeding the baby. First, the bottle has to be heated to reach the desired content temperature. Then the thermometer unit has to be replaced with a nipple. The transition to the second step has to be done quickly to prevent the temperature of the content from dropping significantly. Furthermore, handling a bimetallic coil (as proposed for one of the embodiments) that has been being submerged in the nursing bottle content (i.e. cleaning, storing and disinfecting) is an additional and a relatively labor intensive procedure all in itself.

U.S. Pat. No. 2,648,226 to P. R. Finch, U.S. Pat. No. 2,814,202 to R. D. Frans show temperature indication means mounted in the neck of the bottle and extending into the bottle content.

Regardless of the particular temperature indication means type used this design arrangement would require a special separate care for the temperature indication means that is being submerged in the nursing bottle content. Furthermore, the temperature indication means will have to be food compatible, which will affect the price of the product.

U.S. Pat. No. 3,682,344 to A. N. Lopez shows temperature indication means using liquid bulb-type thermometers installed in the bore formed in the thickened portion of the bottle wall. In the lower portion of the thickened portion of the bottle wall the end of the thermometer is allowed to protrude free at the bottom of the bottle.

Though, the description of the U.S. Pat. No. 3,682,344 does not discuss the assembly process of the bottle, it can be done either through an external opening of the bore at the top of the bottle, or by permanently molding the thermometer into the wall. In the first case the external opening of the bore at the top of the bottle has to be welded later to prevent the bottle contents from leaking.

In either case the process of manufacturing such a bottle would be expensive.

Furthermore, using a liquid bulb-type thermometer in such arrangement carries the obvious risk of having the thermometer crack inside the bottle from the bottle being dropped or otherwise misused by an infant or by accident. The resulting danger of cuts or poisoning is a definite disadvantage of the proposed solutions.

U.S. Pat. No. 3,125,984 to H. Okuyama shows temperature indication means using plurality of recessed pockets on the side wall of the nursing bottle with each pocket containing wax with a particular melting temperature. Each recess also has a mark located behind the layer of wax. When the temperature in the nursing bottle reaches a certain point, the wax in the pockets with a melting temperature equal to or below that point melts and becomes transparent, revealing the temperature mark, and thus, indicating the temperature.

This proposed solution, however, will result in an expensive product due to the numerous parts involved that have to be assembled. The accuracy of such a temperature measurement will be poor: first, due to the insulating layer of plastic (from which the bottle is made) between the substance in the bottle and the wax pockets, and second, due to the limited incremental resolution of the measurements. To increase the resolution of the measurements it will take an increase in the number of pockets as well as the number of recesses in the bottle, consequently making the bottle even more expensive.

U.S. Pat. No. 4,156,365 to F. Heinmets et al shows temperature indication means using a thermochromic paint on the surface of the bottle. The color of the paint changes with the temperature of the bottle, thus providing temperature indication.

The first disadvantage of this method is the poor accuracy of the temperature measurement due to the fact that the film of the thermochromic paint is placed on the external surface of the bottle while the substance the temperature of which is being measured is inside of the bottle; thus, there is a layer of plastic between the substance in the bottle and the temperature sensing film. In addition, the longevity of the paint layer on the external surface of a nursing bottle will be very low, taking into consideration the fact that this surface will be the most frequently touched and rubbed.

U.S. Pat. No. 4,878,588 to J. Ephraim shows temperature indication means using commercially available liquid crystal temperature indicator strips. The strips are bonded to the external surface of the bottle (which is molded so to accommodate the strips) and then sealed with a clear cover to protect the indicator from damage. The liquid crystal temperature indicator strips contain squares of encapsulated liquid crystals, usually sandwiched between mylar sheets. The color of each relevant square changes when the surrounding temperature reaches the level the square was built to indicate.

Unfortunately this method of temperature indication is very inaccurate. Inexpensive commercially available liquid crystal temperature indicator strips provide temperature indication incrementally with a very coarse increment of 5° C. The inaccuracy increases by having a layer of plastic, from which the bottle is made, between the indicator strip and the substance in the bottle, the temperature of which is being measured. The second problem, is the durability of the bonding between the indicator strip and the bottle. In addition, most plastics used for such bottles are not very adherent and the bonding, seemingly adequate at first, perishes rapidly. For the same reason, sealing the indicator strip with a clear cover (as proposed in the U.S. Pat. No. 4,878,588) will not be reliable unless plastic welding is used to seal the strip. However, welding will complicate the manufacturing process, and thus, increase the cost of the product.

Regardless of the precise merits, features, and advantages of the above cited references, none of them achieve or fulfill the goal of providing an inexpensive, simple to handle, long lasting, and safe to use baby nursing bottle with an accurate and reliable content temperature indication.

SUMMARY OF THE INVENTION

It is, therefore, a principle object of the present invention to provide a baby nursing bottle in which the temperature of the very substance of the bottle can be accurately and conveniently measured.

Another object is to provide a baby nursing bottle having temperature measuring means which are unconditionally safe even when the bottle is mishandled.

Another object is to provide a baby nursing bottle that allows to integrate any of the known means of measuring the temperature of the content of the bottle, without involving complex assembly processes of attaching the measuring means to the bottle.

It is also an object of the present invention to provide a baby nursing bottle, with durable long lasting means of measuring temperature of the food in the bottle.

Yet another object is to provide an inexpensive baby nursing bottle with temperature measuring means.

The present invention achieves the forgoing objectives by using the novel features which in its general aspect comprise a nursing bottle having an appendix compartment molded into the walls of the bottle. Thus, such an appendix compartment can receive practically any type of temperature measuring means. By virtue of the compartment, the measuring means placed in the compartment will be surrounded by the substance in the bottle the temperature of which is to be measured. At the same time, the measuring means placed in the compartment will be partitioned from the media by the walls of the compartment. In addition, the measuring means placed in the compartment will be protected by the walls of the bottle from external contacts.

In its narrower aspects, the nursing bottle is an solid shell type vessel molded of plastic that has at least one appendix compartment molded into the shell. The appendix compartment of the bottle is used to encase a temperature measuring device (for example: a bulb-type thermometer, a thermistor-type probe, a thermocouple probe, a liquid crystal temperature indicator strip, a thermochromic paint covered indicator strip, or any other type of temperature measuring devices).

Indication of the temperature measured by the temperature measuring device can be visual, audio (such as digital, dial, color, etc. visual indicators or sound alarms, voice messaging systems, etc. audio indicators) or based on any other forms of signaling.

After the temperature measuring device is installed the hatch of the appendix compartment is to be securely sealed, thus, to lock the temperature measuring device inside of the compartment.

Therefore, the cost is held at a minimum by minimizing the number of parts, using mass produced and off-the-shelf items, minimizing the number of assembly steps, and having the remaining assembly steps be very simple and not requiring complex and expensive equipment.

DETAILED DESCRIPTION OF THE INVENTION

Figure 1:
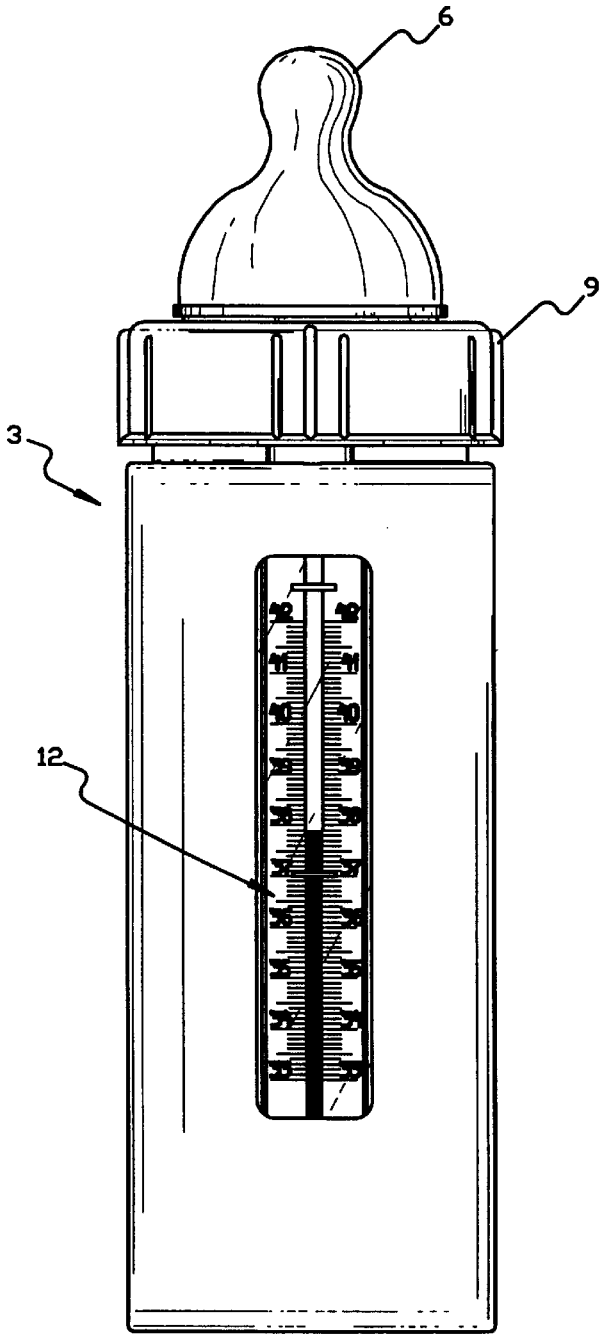
FIG. 1 is a front elevation of the first embodiment of the complete nursing bottle assembly of the present invention.
Figure 2:
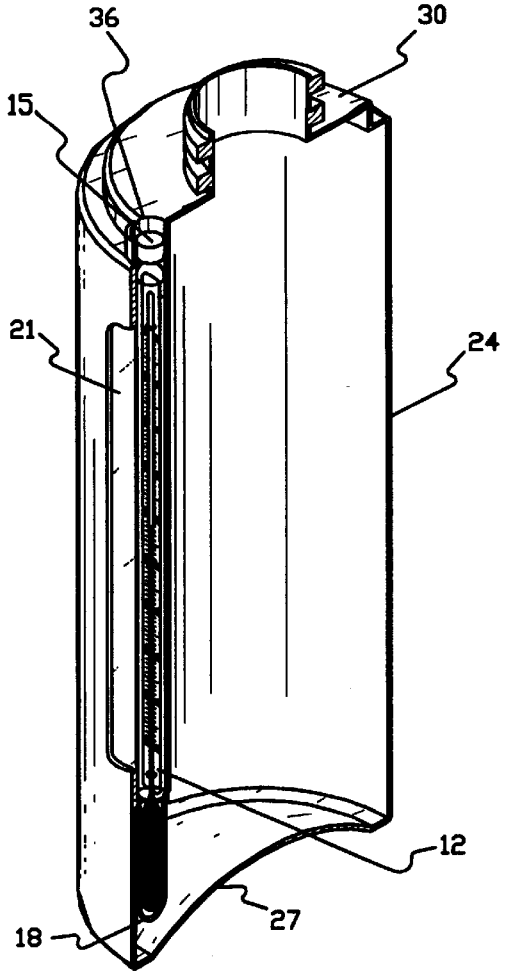
FIG. 2 is an isometric view of the first embodiment of the nursing bottle partial assembly with the half cross-sectioned nursing bottle of the present invention (the cap and the nipple are not shown).
Figure 3:
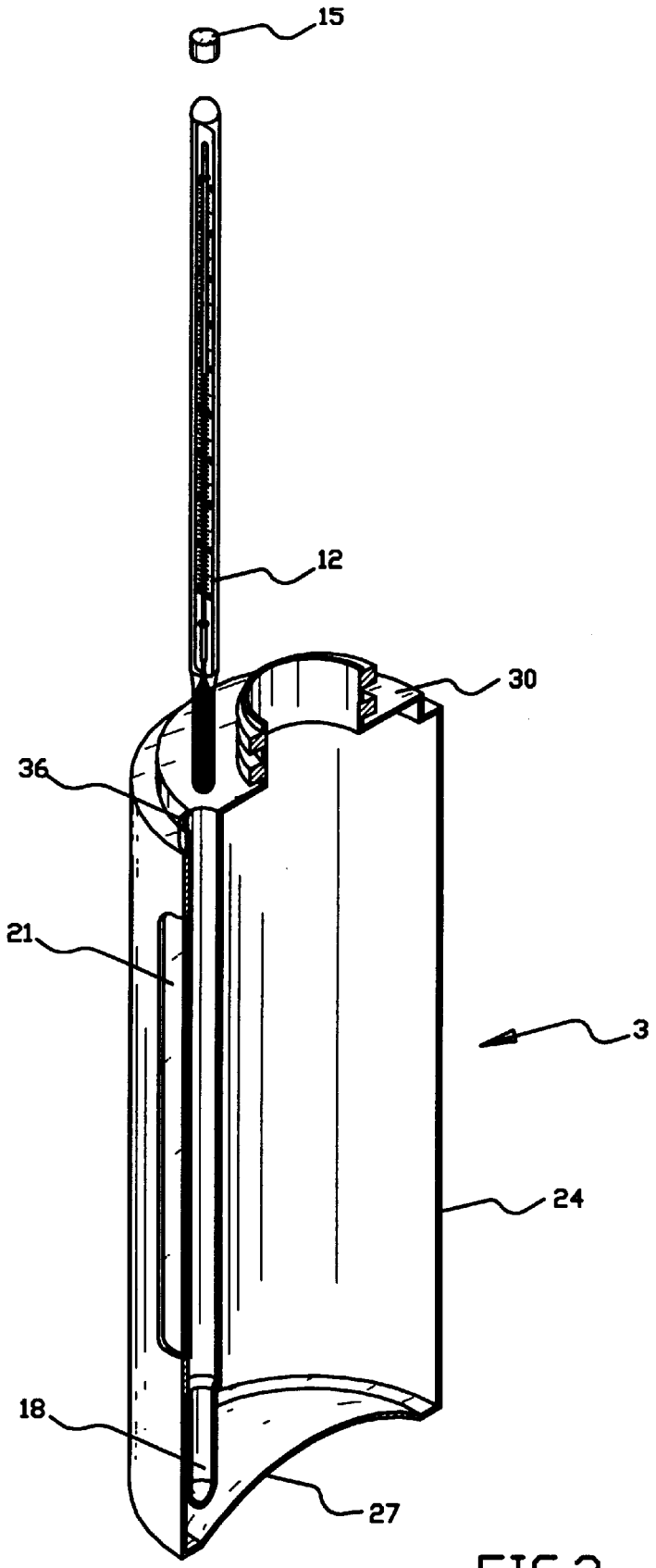
FIG. 3 is an isometric view of the exploded assembly of the first embodiment of the nursing bottle of the present invention.

FIGS. 1–3 disclose a nursing bottle according to the first embodiment of the present invention. This embodiment will be used to represent the most general arrangement of the nursing bottle primarily due to the illustrative simplicity of it. However, any one of the four presented embodiments would be an adequate representative of the general novelty features of the present invention.

The baby nursing bottle of first embodiment comprises a commercially shaped nursing bottle 3 (generally formed of injection molded plastic) that has an elongated hollow cylindrical vessel constituted by an integral shell which is further constituted by a side wall 24, a bottom end wall 27, a top end wall 30 formed with an inlet neck, and an appendix compartment 18 propagated inside of the hollow cylindrical vessel (so as to be submerged into the bottle content when the bottle is filled). The baby nursing bottle of first embodiment further comprises a side wall 24. The appendix compartment 18 is adjacent to the side wall 24. The inlet neck is provided with universal trading (not shown on FIG. 1 and shown on FIG. 2 and FIG. 3) to allow for usage and interchangeability of the cap 9 with the nipple 6. The universal cap and nipple are available as off-the-shelf items.

The appendix compartment 18 of the bottle 3 is generally constructed as a hollow dead end duct with its blind end facing inside of the bottle 3 and the open end facing the external space of the bottle. The first embodiment shown on FIGS. 1–3 is intended to accommodate an off-the-shelf liquid bulb-type thermometer 12 for temperature measurement and indication. According to the first embodiment, at least the joint section of the side wall 24 and of the appendix compartment 18 is made of transparent material (preferably of injection molded plastic), thus to form a window 21 through which the contents of the appendix compartment 18 can be seen.

FIG. 1 shows a front elevation of the first embodiment with the window 21 in front. The scale of the thermometer 12 can be read through the clear plastic of the window 21.

As FIG. 2 shows, the thermometer 12 is encased inside the appendix compartment 18. The thermometer 12 is isolated from the substance of the bottle by the compartment walls, and at the same time protected from mishandling by being shielded from external contacts by the walls of the bottle 3. The thermometer 12 is placed into the appendix compartment 18 through a hatch 36 in the top end wall 30 of the bottle 3 and secured with a retainer 15 (shown on FIGS. 2–3).

Other types of temperature measuring devices (for example: liquid crystal temperature indicator strip, thermochromic paint, bimetallic thermometer probe) can be used with the bottle 3 in accordance with the present invention. Though, the use of different types of temperature measuring devices might affect the shape and the dimensions of the appendix compartment 18 as well as the hatch 36 to accommodate the particular devices, this would not change the essence of the present invention, and therefore, will not detract from the invention's advantages.

Figure 4:
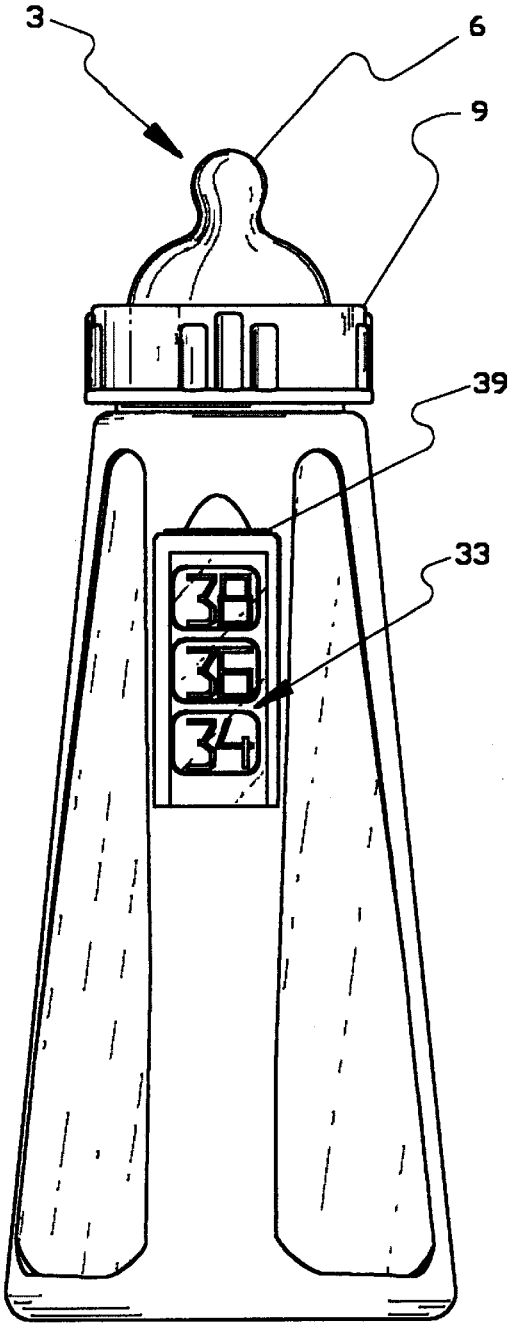
FIG. 4 is a front elevation of the second embodiment of the complete nursing bottle assembly of the present invention.
Figure 5:
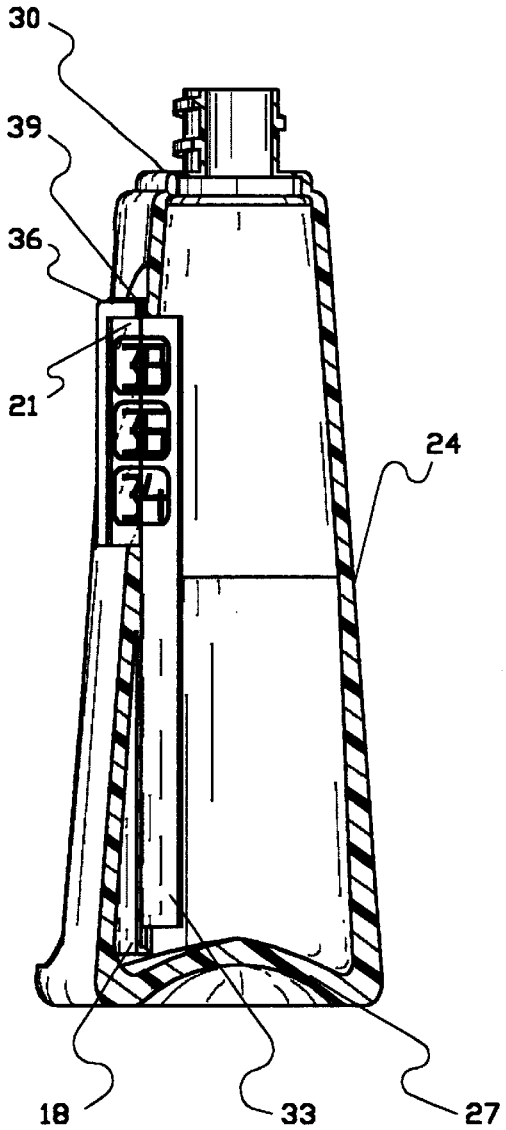
FIG. 5 is an isometric view of the second embodiment of the nursing bottle partial assembly with the half cross-sectioned nursing bottle of the present invention (the cap and the nipple are not shown).

FIGS. 4–5 disclose a nursing bottle according to a second embodiment of the present invention. The baby nursing bottle of the second embodiment comprises an alternately commercially shaped nursing bottle 3 with an elongated hollow cone shaped vessel, constituted by an integral shell which is further constituted by an integral side wall 24, a bottom end wall 27, a top end wall 30 (constructed with an inlet neck), and an appendix compartment 18 adjacent to the side wall 24 of the bottle 3 and propagated inside of the hollow conical vessel. The inlet neck of the bottle 3, per the second embodiment of the present invention, is provided with universal threading (not shown on FIG. 4, but shown on FIG. 5) to allow for usage and interchangeability of the cap 9 with the nipple 6. The appendix compartment 18 of the second embodiment has a long and narrow cavity to accommodate an off-the-shelf liquid crystal-type strip thermometer 33.

The strip thermometer 33 has numeral designation within the desirable baby food temperature range (34° C. to 38° C.). Temperature can be read through the clear plastic of the window 21. Naturally, any equivalent temperature scales as well as color indications of the temperature can alternately be used with any of the embodiments.

When the strip thermometer 33 is installed into the cavity of the appendix compartment 18 the hatch 36 is securely closed with retainer 15 (not shown on FIG. 4 and FIG. 5) or sealed by welding the plastic of the hatch. FIG. 4 and FIG. 5 show a plastic welded seal 39 to exemplify the plastic welding option for closing the appendix compartment 18.

Figure 6:
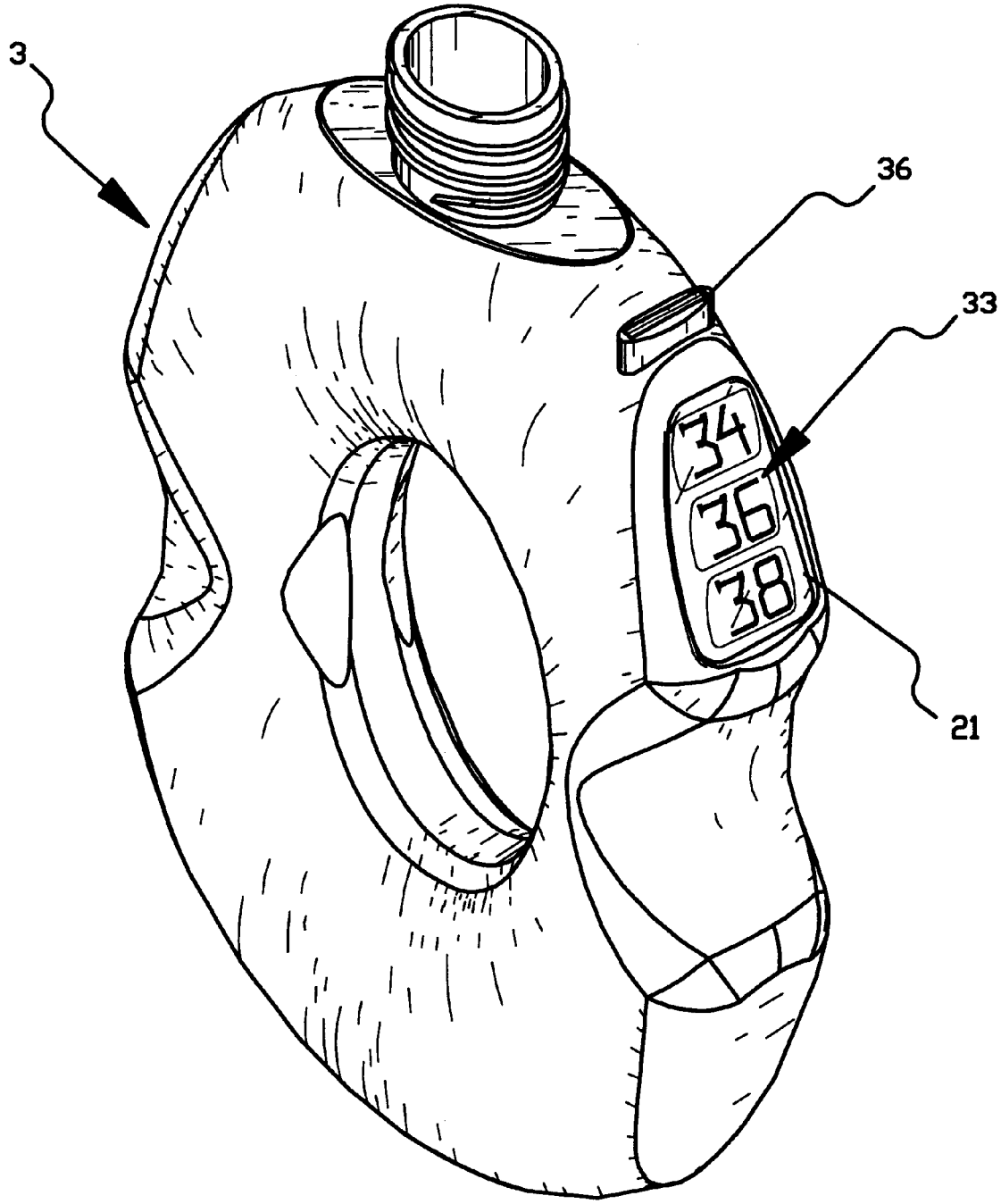
FIG. 6 is an isometric view of the third embodiment of the nursing bottle partial assembly (the cap and the nipple are not shown).

FIG. 6 discloses a nursing bottle according to a third embodiment of the present invention. The baby nursing bottle of the third embodiment comprises yet another alternately commercially shaped nursing bottle 3. The bottle 3, according to a third embodiment, is a donut shaped vessel constituted by an integral shell with a standard threaded inlet neck, and an appendix compartment (not shown on FIG. 6) adjacent to the wall 24 of the bottle 3 and propagated inside of the hollow vessel. The appendix compartment of the third embodiment has a long and narrow cavity (not shown on FIG. 6) with a hatch 36 on the top end wall 30 of the bottle 3. According to the third embodiment of the present invention, the appendix compartment cavity is designed to accommodate a strip type thermometer 33 with numerals that can be seen through the clear window 21. The numerals are painted with an off-the-shelf thermochromic paint and become visible at the temperature represented by the corresponding numerical symbol. The type of numeral designation illustrated for the strip type thermometer 33 of the third embodiment is arranged within the desirable temperature range for baby foods. Naturally, the general principal of this invention does not limit the use of any alternate temperature range, alternate corresponding temperature scale, or alternate color temperature indication. FIG. 6 shows all of the numerals simultaneously revealed for purposes of illustration.

Figure 7:
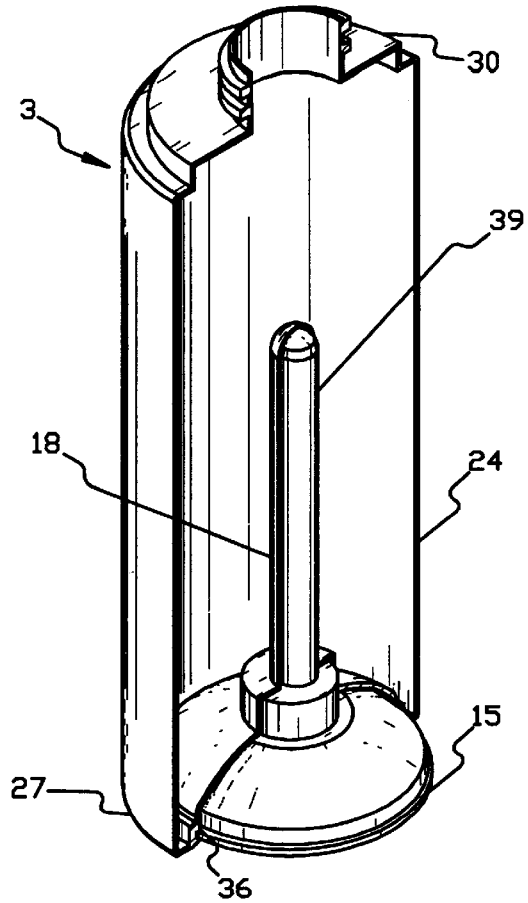
FIG. 7 is an isometric view of the fourth embodiment of the nursing bottle partial assembly with the half cross-sectioned nursing bottle of the present invention (the cap and the nipple are not shown).
Figure 8:
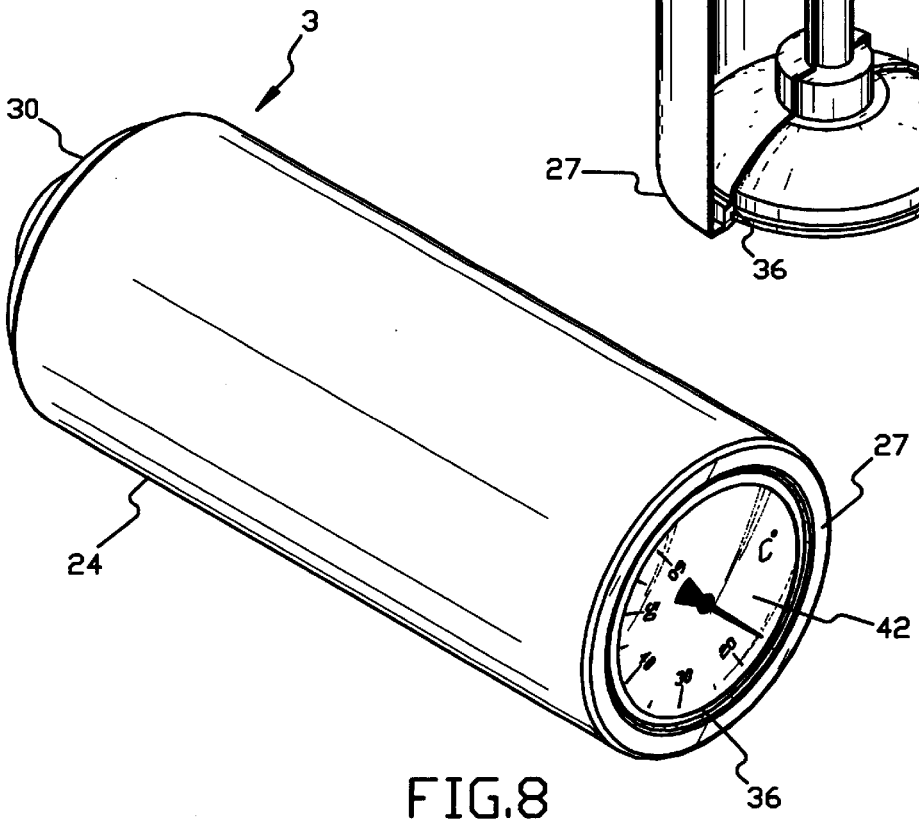
FIG. 8 is another isometric view of the fourth embodiment of the nursing bottle partial assembly of the present invention showing the bottom portion of the nursing bottle assembly (the cap and the nipple are not shown).

FIGS. 7–8 disclose a nursing bottle according to a fourth embodiment of the present invention. The baby nursing bottle of the fourth embodiment comprises a nursing bottle 3 shaped similar to the nursing bottle of the first embodiment (generally formed of injection molded plastic) with an inlet neck provided with universal threading (not shown on FIG. 8) to allow for usage and interchangeability of a standard cap with a standard nipple (not shown on FIGS. 7 and 8). The elongated hollow cylindrical vessel of the bottle 3 is constituted by an integral shell, further constituted by a side wall 24, a bottom end wall 27, and a top end wall 30. The bottom end wall 27 is constructed with an appendix compartment 18 having a hatch 36 molded into the middle of the bottom end wall 27 and propagated inside of the hollow cylindrical vessel (so to be submerged into the bottle content when the bottle is filled).

According to the fourth embodiment, the side wall 24 and the appendix compartment 18 are constructed without a transparent joint section (as opposed to the arrangements of the embodiments 1 through 3) in the wall of the bottle 3. The appendix compartment 18 of the fourth embodiment is to accommodate a thermometer probe 39 (not shown on FIG. 8) connected to a secondary temperature indicator 42. The secondary temperature indicator 42 is connected to the thermometer probe 39, and secured inside of the hatch 36 with a retainer 15.

The arrangement according to the fourth embodiment allows the use of a broad variety of thermometer probes (thermocouple-type probes, thermistor-type probes, a thin film detector-type probes, etc.) and temperature indicators. Indication of the desirable temperature level measured by the thermometer probes might be arranged in visual forms (for example: digital indicators, dial indicators, LED indicators, color indicators, etc.) or as audio signals (for example: sound alarms or voice messages).

In light of the above teachings it is possible to compile numerous modifications and variations of the present invention. It is therefore to be understood that, within the scope of the appended claims, the invention may be practiced otherwise than specifically described.

What is claimed is:

1. A nursing bottle, comprising:

a hollow vessel constituted by an integral shell having a least one inlet opening into the inner chamber of said vessel.

at least one elongated hollow appendix compartment with an inlet opening outward to said vessel and attached to said integral shell, said appendix compartment being propagated inwardly of said vessel, and formed so that substantial wall area of said appendix compartment being un-adjoined to said integral shell of said vessel, a temperature sensing means disposed inside said appendix compartment for determining temperature within the inner chamber of said vessel, whereby said vessel will be provided with said temperature sensing means for determining the content temperature inside of said vessel.

2. The nursing bottle of claim 1 wherein a portion of said integral shell is made adjacent to a portion of said appendix compartment, and formed of clear material for providing visibility of said temperature measuring means.

3. The nursing bottle of claim 1 wherein said vessel is formed of injection molded plastic.

4. The nursing bottle of claim 1 wherein said vessel is formed of blow-molded plastic.

5. The nursing bottle of claim 1 wherein said temperature measuring means is a liquid bulb-type thermometer.

6. The nursing bottle of claim 1 wherein said temperature measuring means is a liquid crystal temperature indicator strip.

7. The nursing bottle of claim 1 wherein said temperature measuring means is a thermochromic paint strip.

8. The nursing bottle of claim 1 wherein said temperature measuring means is a bimetallic thermometer probe.

9. The nursing bottle of claim 1 wherein said temperature measuring means is a thermistor type thermometer probe.

10. The nursing bottle of claim 1 wherein said inlet opening of said appendix compartment is sealed with a hatch retainer.

11. The nursing bottle of claim 1 wherein said inlet opening of said appendix compartment is sealed by plastic welding.

* * * * *